US005629725A

United States Patent [19]

Buican

[11] Patent Number: 5,629,725

[45] Date of Patent: May 13, 1997

[54] CARRIAGE MOUNT FOR AN INK JET CARTRIDGE

[75] Inventor: Eugene Buican, Cordova, Tenn.

[73] Assignee: Brother International Corporation, Somerset, N.J.

[21] Appl. No.: 368,537

[22] Filed: Jan. 4, 1995

[51] Int. Cl.[6] ..... B41J 2/01

[52] U.S. Cl. ..... 347/49

[58] Field of Search ..... 347/49, 50, 86, 347/87; 312/9.55, 9.57, 9.63; 248/222.11

[56] References Cited

U.S. PATENT DOCUMENTS 4,706,097 11/1987 Harmon ..... 347/50
4,729,557 3/1988 Kiyohara ..... 271/272
4,907,018 3/1990 Pinkerpell et al. ..... 347/50
5,202,702 4/1993 Terasawa et al. ..... 347/32
5,372,512 12/1994 Wilson et al. ..... 439/67

*Primary Examiner*—Benjamin R. Fuller
*Assistant Examiner*—L. Anderson
*Attorney, Agent, or Firm*—Oliff & Berridge

[57] ABSTRACT

An ink cartridge carrier for an ink cartridge of an ink jet printing device is resiliently mounted to the ink cartridge carrier to minimize the size of the ink cartridge carrier. The reduction in size is accomplished by mounting the latching mechanism to the ink cartridge carriage with an expansion spring positioned in a spring opening in both the latching mechanism and the ink cartridge carrier. Only a latching lip of the latching member extends above the ink cartridge carrier so as to engage an upper surface of the ink cartridge.

19 Claims, 20 Drawing Sheets

CARRIAGE MOUNT FOR AN INK JET CARTRIDGE

BACKGROUND OF THE INVENTION

The invention relates to a latching mechanism for positively attaching an ink cartridge used with an ink jet printing apparatus to an ink cartridge carrier.

Prior art latching mechanisms for attaching an ink cartridge to an ink cartridge carrier used a spring inserted between a portion of the ink cartridge carrier body and a latching portion that biases the latching portion downwardly (FIG. 20). Such a structure, with a spring above the latching portion, increases the size of the ink cartridge carrier thereby increasing the size of the printing apparatus so that the printing area could accommodate the enlarged ink cartridge carrier. This overall enlargement of the printing apparatus and the ink cartridge carrier increases the cost of the printing apparatus. It also results in an inefficient use of space.

SUMMARY OF THE INVENTION

The invention employs a spring and a latching body mounted in an opening of the ink cartridge carrier. The spring is an expansion spring with one end of the spring mounted against the upper surface of the opening in the ink cartridge carrier and a lower surface mounted against a portion of the latching mechanism to force the latching mechanism downwardly to engage the ink cartridge carrier.

Thus, the object of the invention is to minimize the space necessary for the latching mechanism on the ink cartridge carrier.

Another object of the invention is to reduce the size of the printing area of the printing apparatus.

A third object of the invention is to lower the cost of the printing apparatus by the reduction in size.

To accomplish the above objects, the latching apparatus of the invention comprises a first side section, a second side section and a connecting section, the three sections having a U-shape when viewed in plan; a positioning bar extending between said first side section and said second side section parallel to and offset from the connecting section; a latching spring; and a latching member mounted to the connecting section wherein the connecting section has an opening for receiving a first part of the latching member and the spring is mounted between the first part of the latching member and an opposing part of the opening in the connecting section.

BRIEF DESCRIPTION OF THE DRAWINGS

The invention will be better understood from the detailed description given herein below and the accompanying drawings which are given by way of illustration only, and thus are not limiting of the invention.

DESCRIPTION OF THE PREFERRED EMBODIMENT

Figure 1:
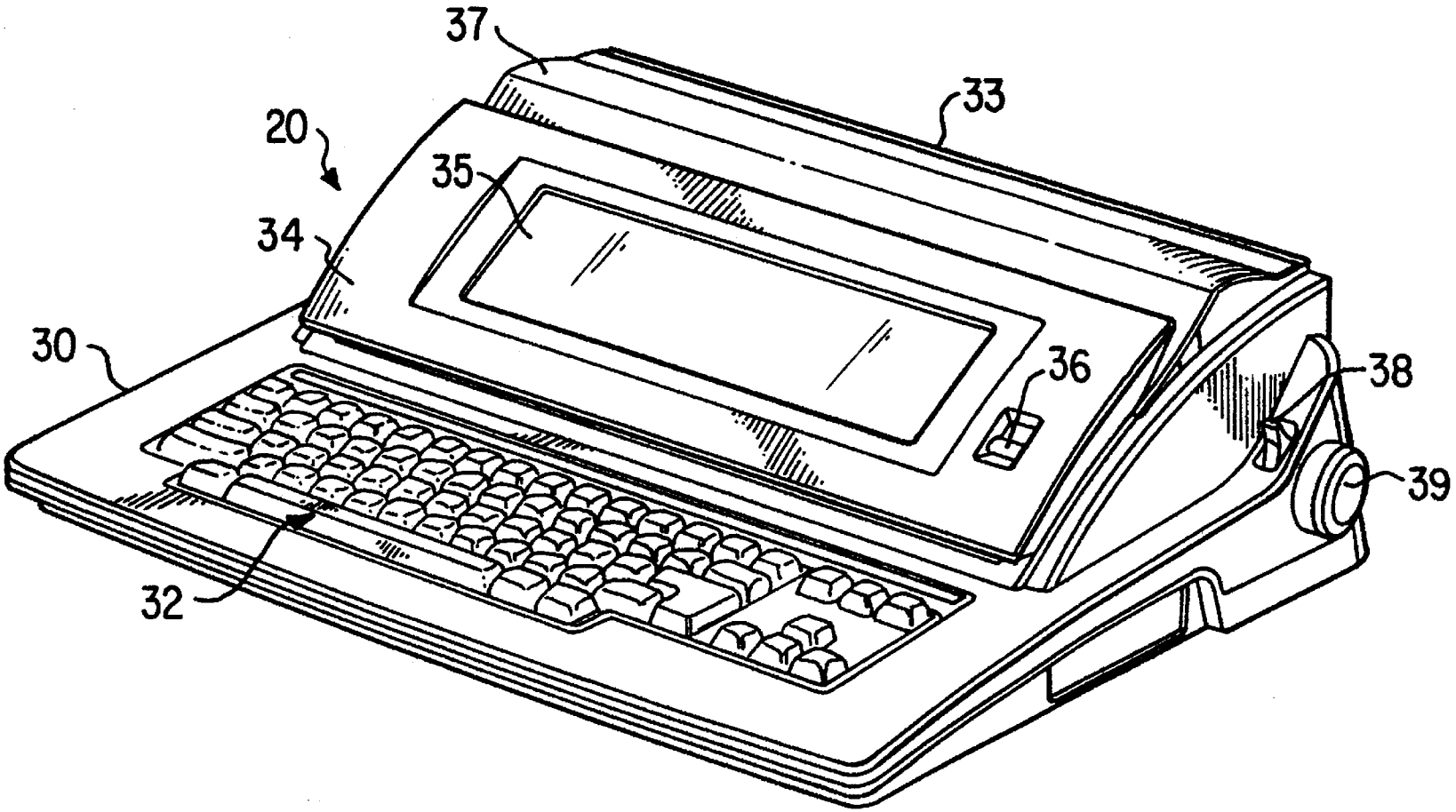
FIG. 1 is a perspective view of an electric typewriter embodying the invention.

The invention will hereinafter be described with reference to the drawings. FIG. 1 shows an electronic typewriter 20 embodying the invention. The electronic typewriter 20 is being used for illustrative purposes only as the invention may be embodied in other electronic printing apparatuses such as printers and facsimile machines employing ink jet printing elements. The print cartridges may be of either a thermal cartridge or a piezo electric cartridge type.

The electronic typewriter 20 of FIG. 1 has an outer frame 30. The input means comprises a keyboard 32 having alphanumeric, function, cursor, and control keys as are known in the art. Obviously, the input means would differ for a printer or a facsimile machine. A front panel 34 contains a display 35 and a contrast control 36 is provided for controlling contrast of the display 35. An upper panel 37 is provided to permit access to the interior of the outer frame 30. The front panel 34 may be rotated toward the keyboard and the upper panel 37 rotated away from the keyboard to provide access to the interior of the outer frame 30. A paper release 38 and a knob 39 for permitting rotation of main roller 91 (FIG. 6) are provided to one side of the outer frame 30. A back panel 33 lowers to provide a paper tray for feeding the sheet of paper prior to printing and for receiving the printed sheet of paper.

FIGS. 2–5 show the printing area of the invention. As previously noted, the invention is being described in the context of the electronic typewriter 20 of FIG. 1 but is applicable to any printing apparatus using ink jet print technology.

The printing means are mounted to a mounting frame 70 (FIG. 4) comprising a first side frame 71, a first lateral frame 72, a second side frame 73, and a second lateral frame 74. For purposes of this description, the first side frame 71 may be considered to the left when viewed in the figures and the first lateral frame 72 may be considered as closest to the observer when mounted in a printing mechanism. However, when actually mounted within a printing apparatus, the orientation may vary depending upon the structure of the printing apparatus.

Figure 2:
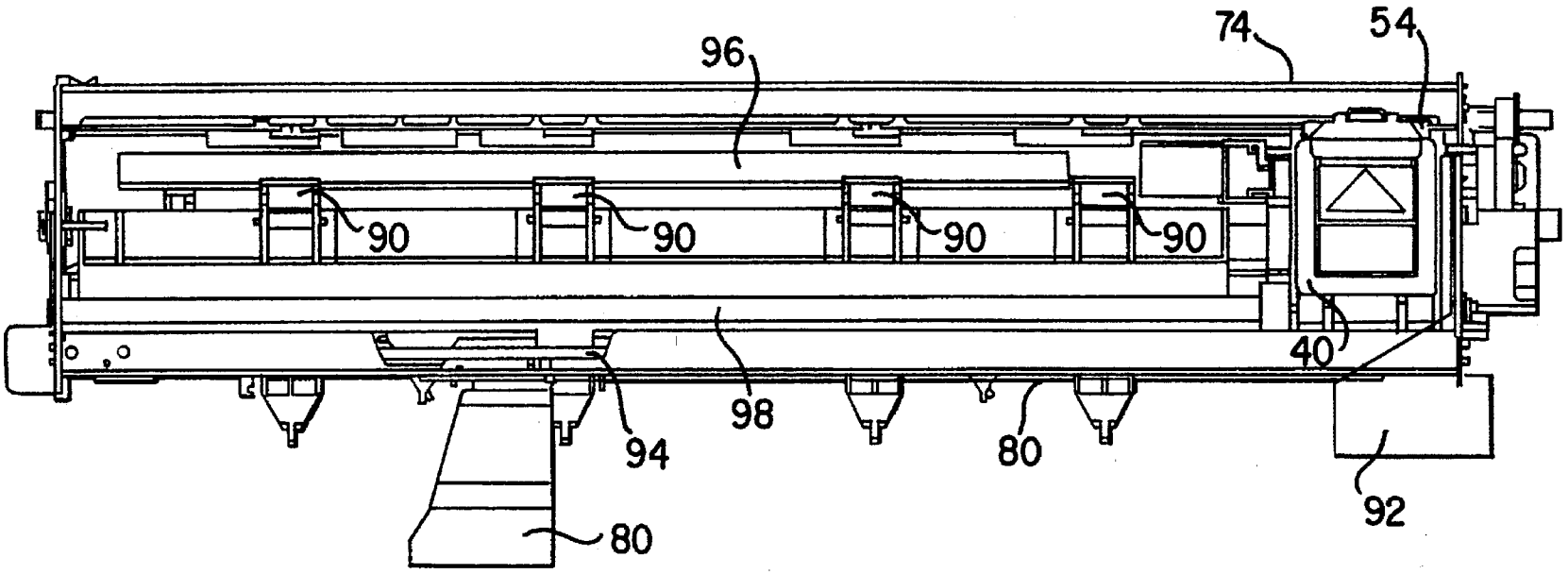
FIG. 2 is a top plan view of the print area with the ink cartridge carrier at a cleaning position.
Figure 4:
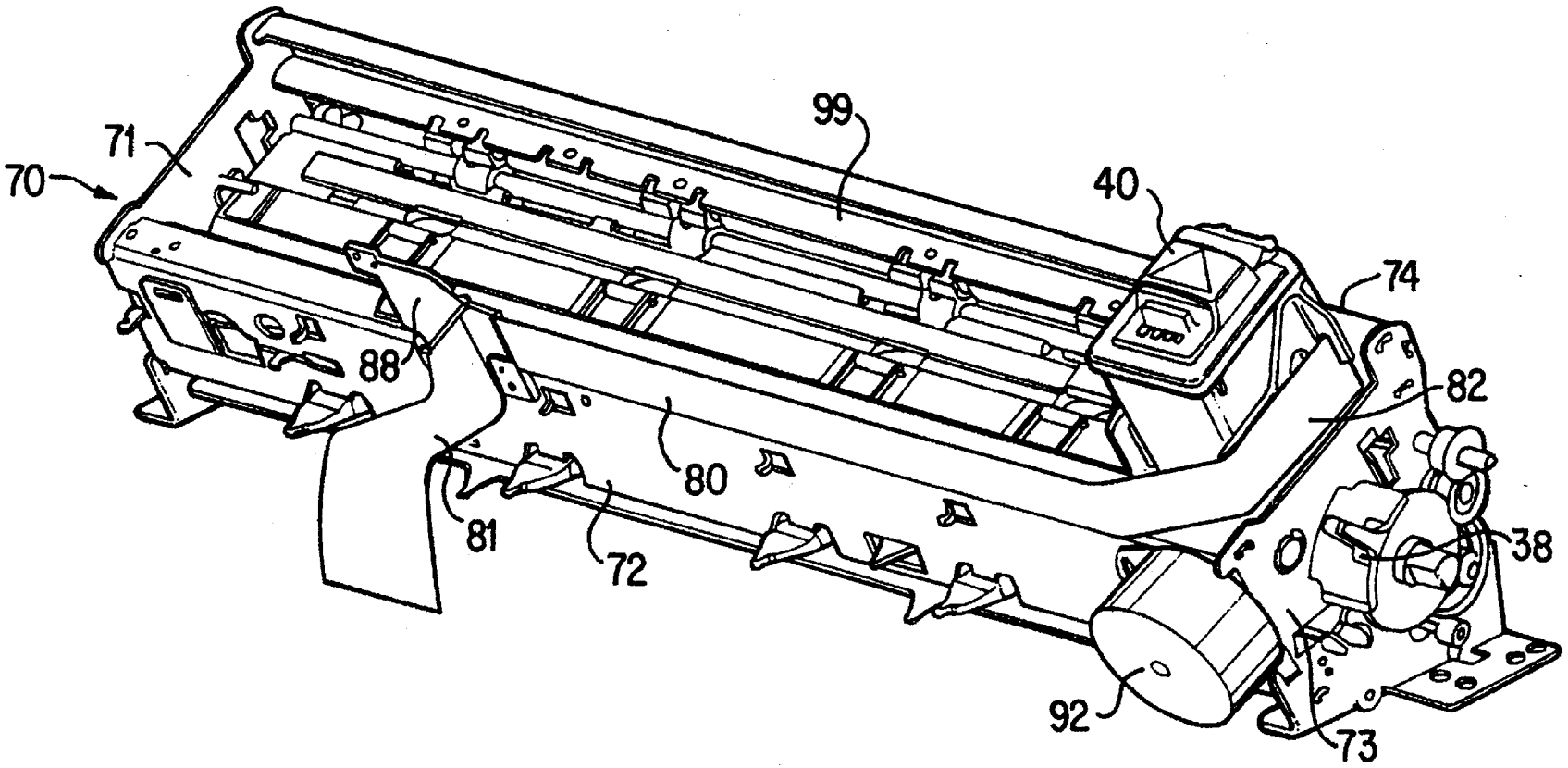
FIG. 4 is a top perspective view of the print area with the ink cartridge carrier at the cleaning position.

Extending between the first and second side frames 71,73 are a guide shaft 98 and a guide rail 99 (FIGS. 2 and 4). The guide shaft 98 and the guide rail 99 support the ink cartridge carrier 54 upon which the ink cartridge 40 is mounted. A motor 92 drives a timing belt 94 mounted to the ink cartridge carrier 54 to reciprocate the ink cartridge carrier 54 laterally along the guide shaft 98 and the guide rail 99.

A single sheet of paper is fed around feed path 102 (FIG. 6) and exits the direction shown by arrow A. At the entrance of the feed path 102 is the paper tray 33. A cut sheet feeder (not shown) feeds paper to paper feed opening 102*a* and thence to paper feed path 102. The paper feed opening 102*a* is also used to feed thicker paper products, such as postcards. Thus, the feed of paper may be a single sheet at a time or from a cut sheet feeder using known feed technologies. Further, the invention can be used with fan fold paper fed by a tractor feed.

The paper is fed through the feed path 102 by rotation of the main roller 91 (FIG. 6) and pinch rollers 90 (FIG. 2), across the block 96 and exited between feed rollers 104 and traction rollers 105. The feed rollers 104 are made of a resilient material and the traction rollers 105 are preferably of a metal having raised linear teeth. The raised linear teeth, triangular in cross-section, are smoothed at their apex such that the combination of the raised teeth of the traction rollers 105 and the resilient surface of the feed rollers 104 provide a positive gripping of the paper sheet.

Figure 3:
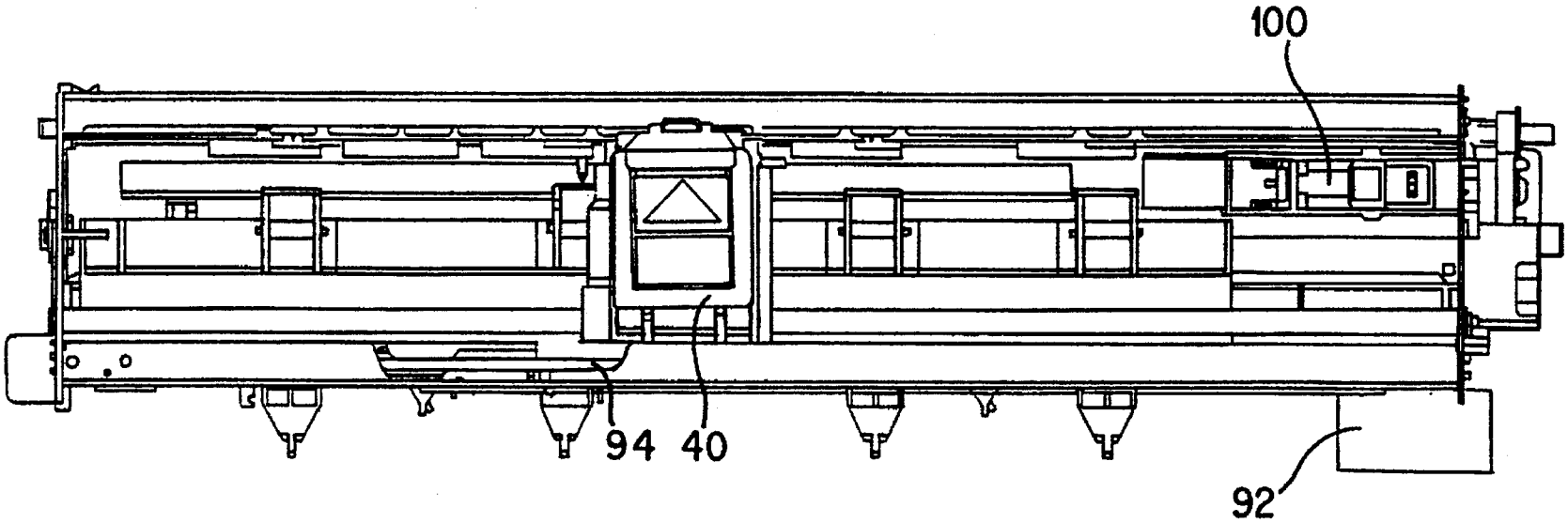
FIG. 3 is a top plan view of the print area with the ink cartridge carrier at a mid-print position, the figure is shown without the flexible cable.
Figure 5:
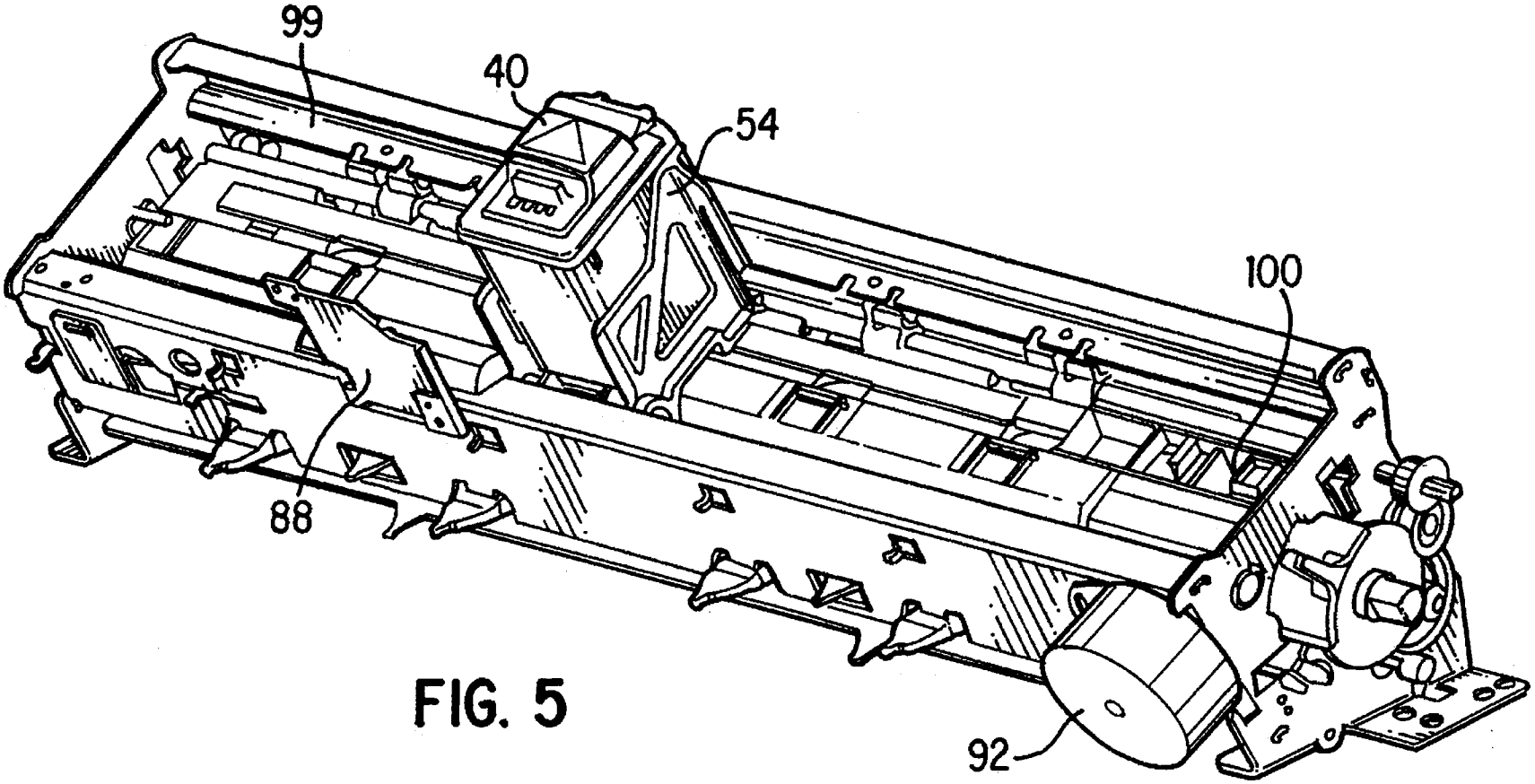
FIG. 5 is a top perspective view corresponding to FIG. 3.

Adjacent to the second side frame 73 is a head maintenance station 100 (FIGS. 3 and 5). The head maintenance station 100 may comprise a wiper member and a capping station to cover the printhead. A type maintenance station is shown in U.S. Pat. No. 5,202,702. FIGS. 2 and 4 show the ink cartridge carrier 54 at the head maintenance station 100.

During printing, the ink cartridge carrier 54 reciprocates along the guide shaft 98 and guide rail 99 between a position substantially adjacent to the first side frame 71 and a position adjacent to the head maintenance station 100. Head cleaning is executed on a predetermined basis that may be established based upon the number of lines printed, a set time interval, a combination of a number of characters and lines printed, or other appropriate measures depending upon the characteristics of the ink and the ink cartridge 40.

The ink cartridge carrier 54 will be described with reference to FIGS. 6–11. The ink cartridge carrier 54 is molded of a high strength resin material. An example of such a material is a polycarbonate with 10% fiber glass. The molded ink cartridge carrier 54 comprises a first side frame section 56, a second side frame section 57, a center frame section 55 connecting the first and second side frame sections 56,57, and a base frame section 58. The base frame section includes a guide shaft mount 60 and a positioning bar 58*a*.

The center frame section 55 has molded thereto guide members 59. Between guide members 59 is a notch 101. The ink cartridge carrier 54 is mounted to guide shaft 98 using guide shaft mount 60 and guide rail 99 is received in notch 101. To a rear portion of guide shaft mount 60 is formed a timing belt attachment bracket 61. The timing belt 94 is attached to the timing belt attachment bracket 61. The timing belt 94 may be either a split belt wherein each end of the timing belt 94 is attached to the timing belt attachment bracket 61 or it may be an endless belt with an attachment device, mounted on the timing belt 94, that is attached to the timing belt attachment bracket 61. In either case, the timing belt 94 is fixed with respect to the ink cartridge carrier 54 so that rotation of the motor 92 causes the timing belt 94 to be moved by rotation of an output shaft and pulley (not shown) thereby causing the ink cartridge carrier to reciprocate along the guide shaft 98 and guide rail 99.

Extending from each side frame section 56,57 is a wing 51. A plane passing through a surface of the wings 51 opposes a plane passing through an inner surface of the center frame section 55 and is parallel thereto. The gap between the two respective planes defines slots 65,66. A first slot 65 is defined at the junction of first side frame 56 and center frame section 55 and a second slot 66 is defined at the junction of second side frame section 57 and center frame section 55. Protruding from the surface of the wing 51 extending from first side frame section 56 is entry latching pin 67 and protruding from wing 51 extending from second side frame section 57 are end latching pins 68. Although as shown in this preferred embodiment of the ink cartridge carrier, the ink cartridge carrier 54 has one entry latching pin 67 and two end latching pins 68, other configurations of the latching pins could be used.

Figure 9A:
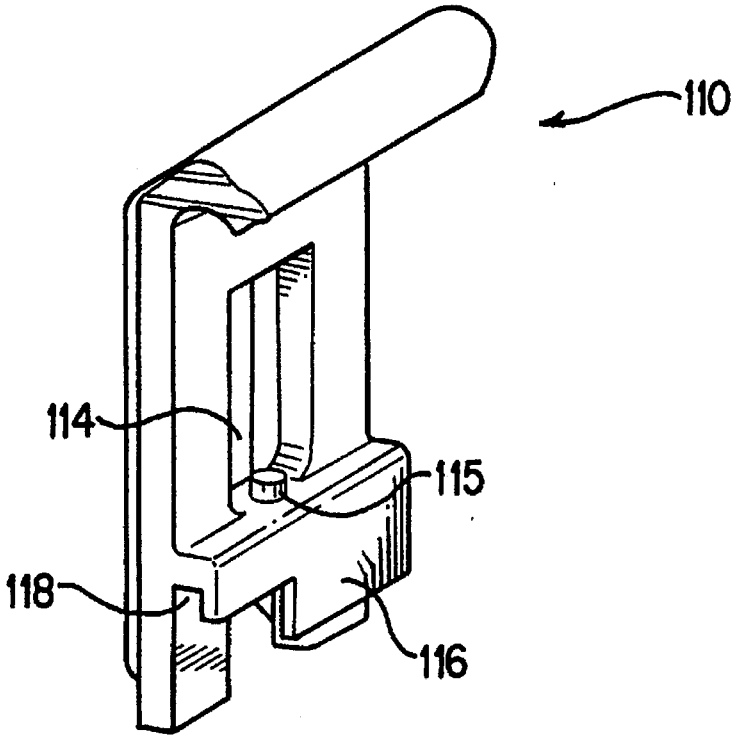
FIGS. 9A and 9B are front and rear perspective views of the latching bracket.
Figure 9B:
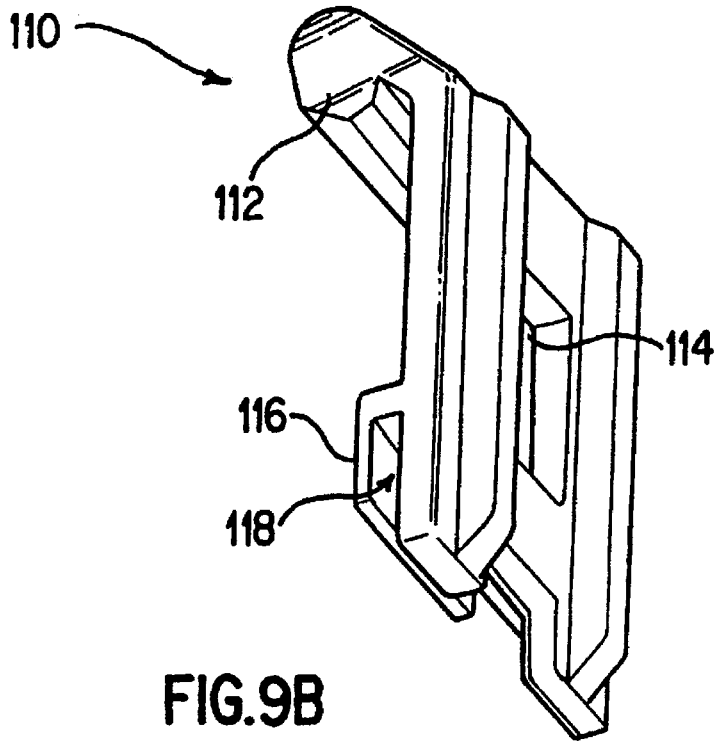
Figure 10:
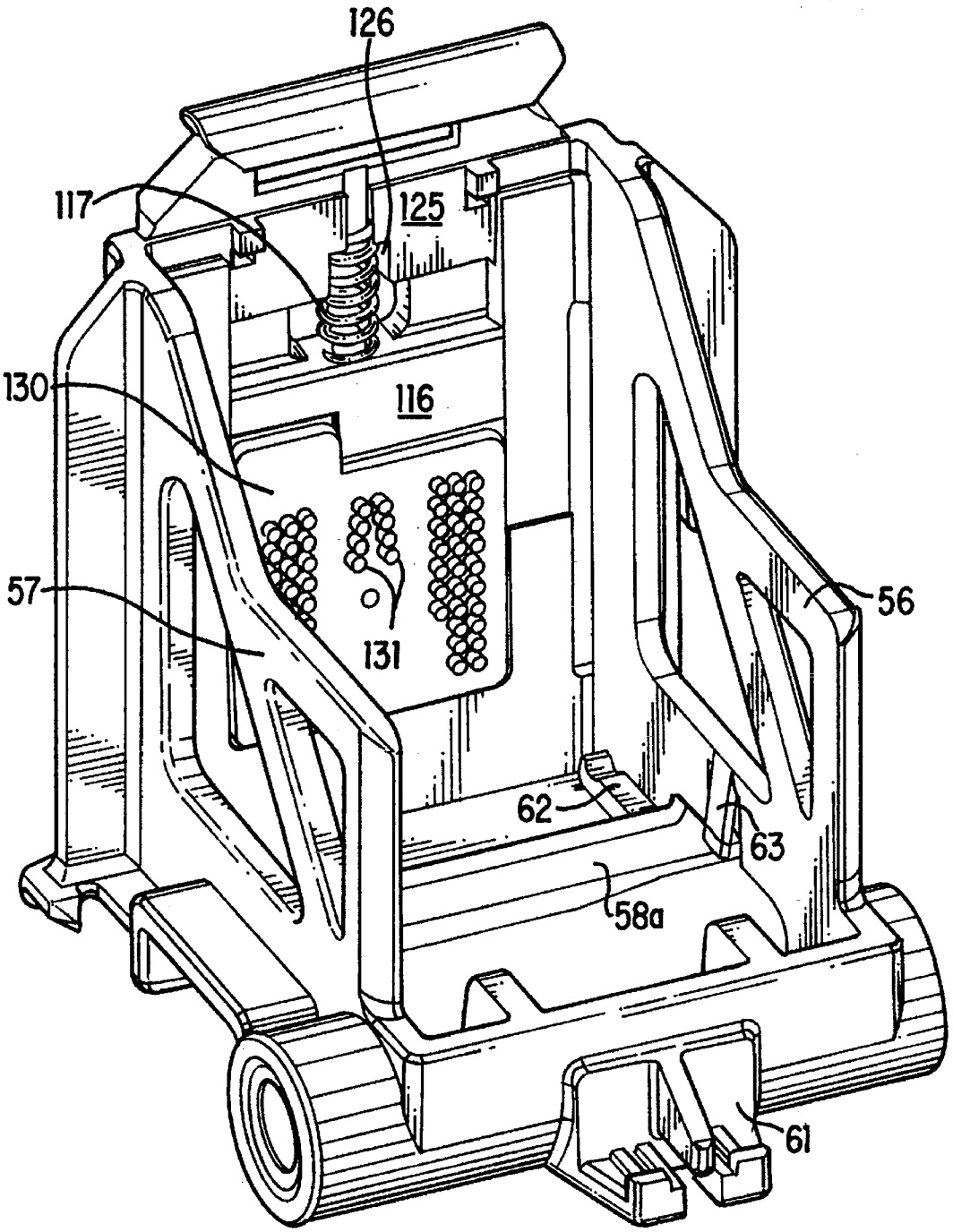
FIG. 10 is a left front, top perspective view of the ink cartridge carrier with the latching bracket attached.

To the ink cartridge carrier 54 is mounted a latching bracket 110 (FIG. 9A, 9B). The latching bracket 110 is formed of a high impact resin, such as those used for the ink cartridge carrier 54. The latching bracket 110 has an opening 114 and extending inwardly, that is toward the ink cartridge carrier 54, is a retention plate 116 having a downwardly descending L-shape, in cross section, to create a mounting notch 118 between the main bracket body and the descending leg of the retention plate 116. Protruding from an upper surface of the retention plate 116 is a spring guide 115.

Figure 16:
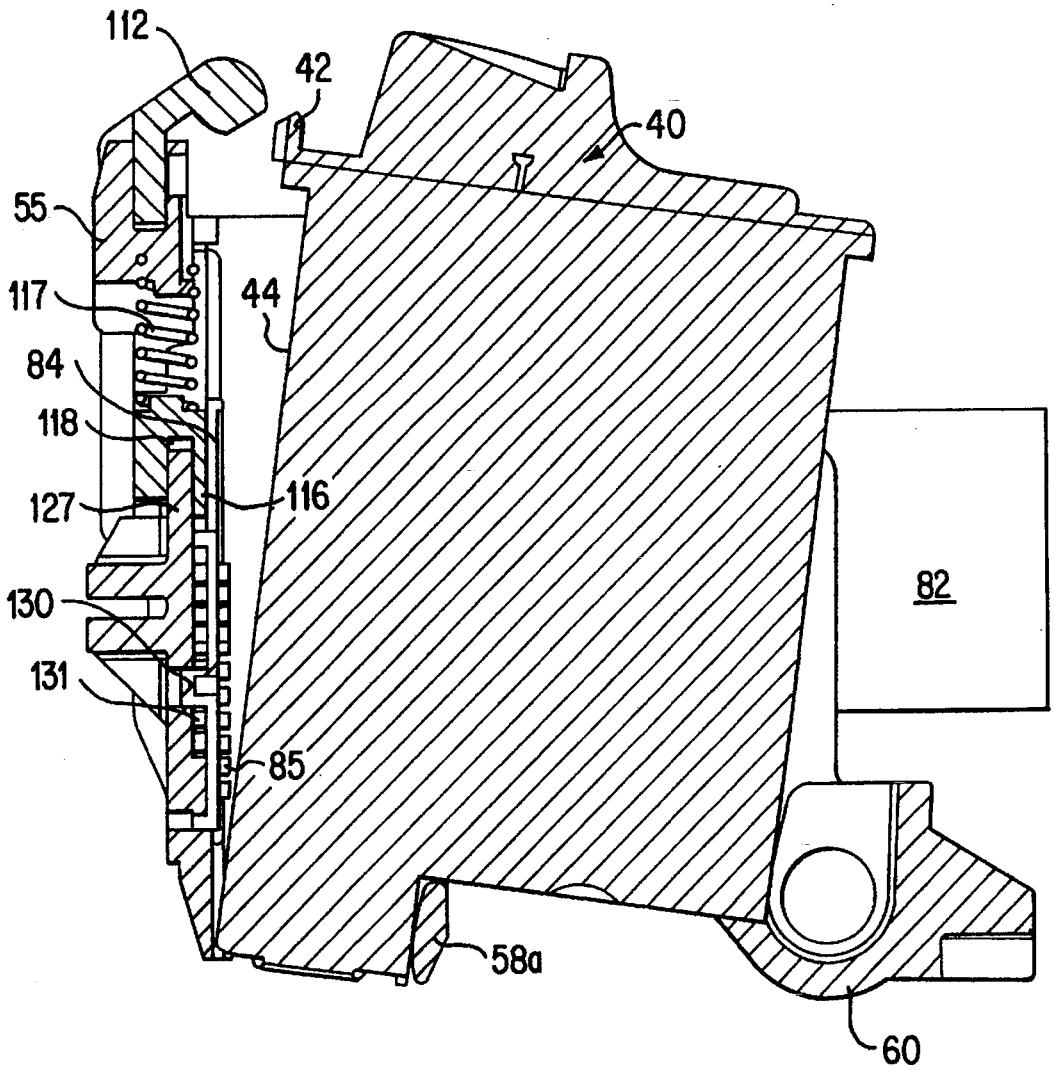
FIG. 16 is a side cut-away view of an ink cartridge being mounted on the ink cartridge carrier.
Figure 17:
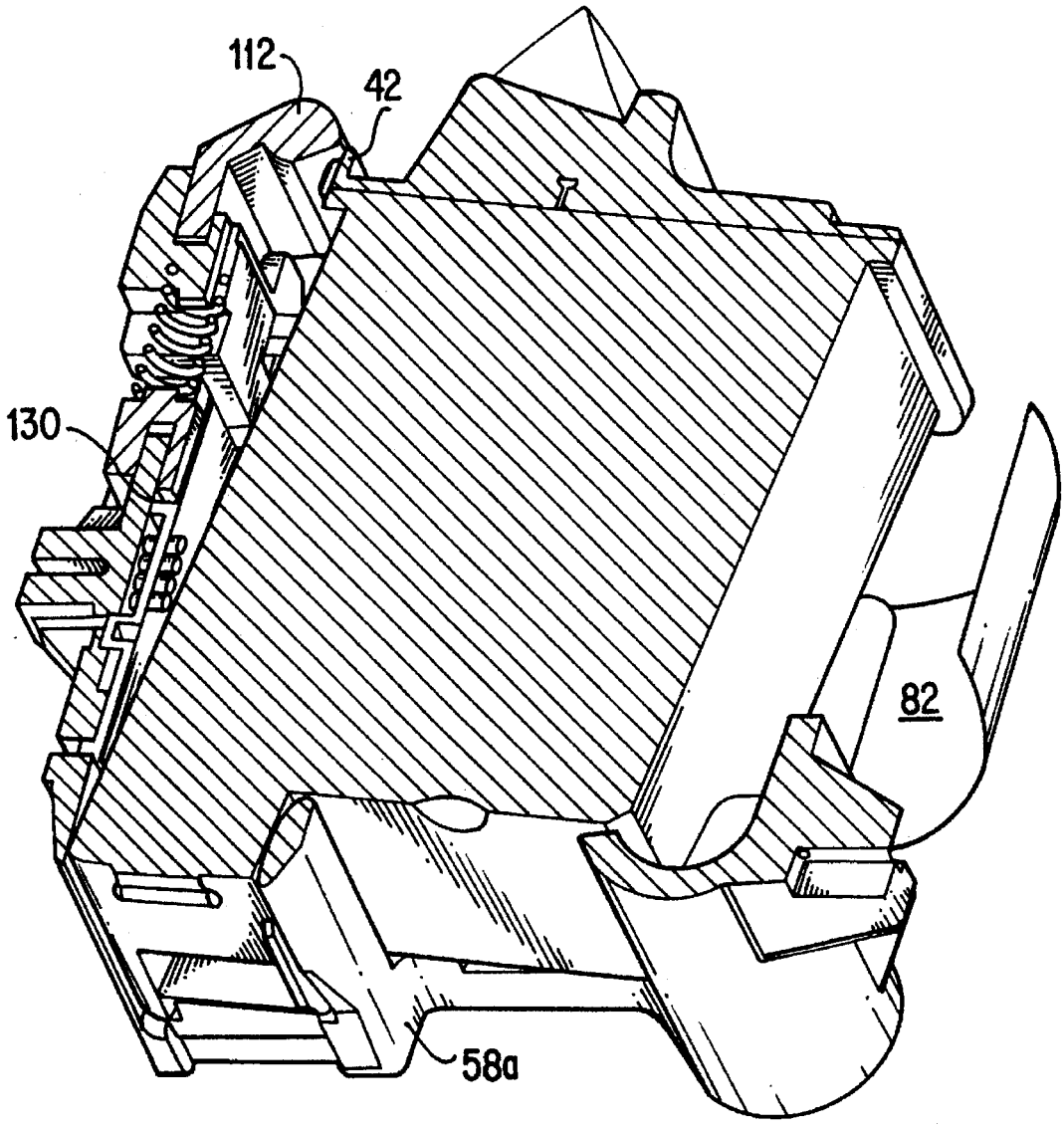
FIG. 17 is a bottom angle, cross-sectional perspective view of the ink cartridge being mounted on an ink cartridge carrier.
Figure 18:
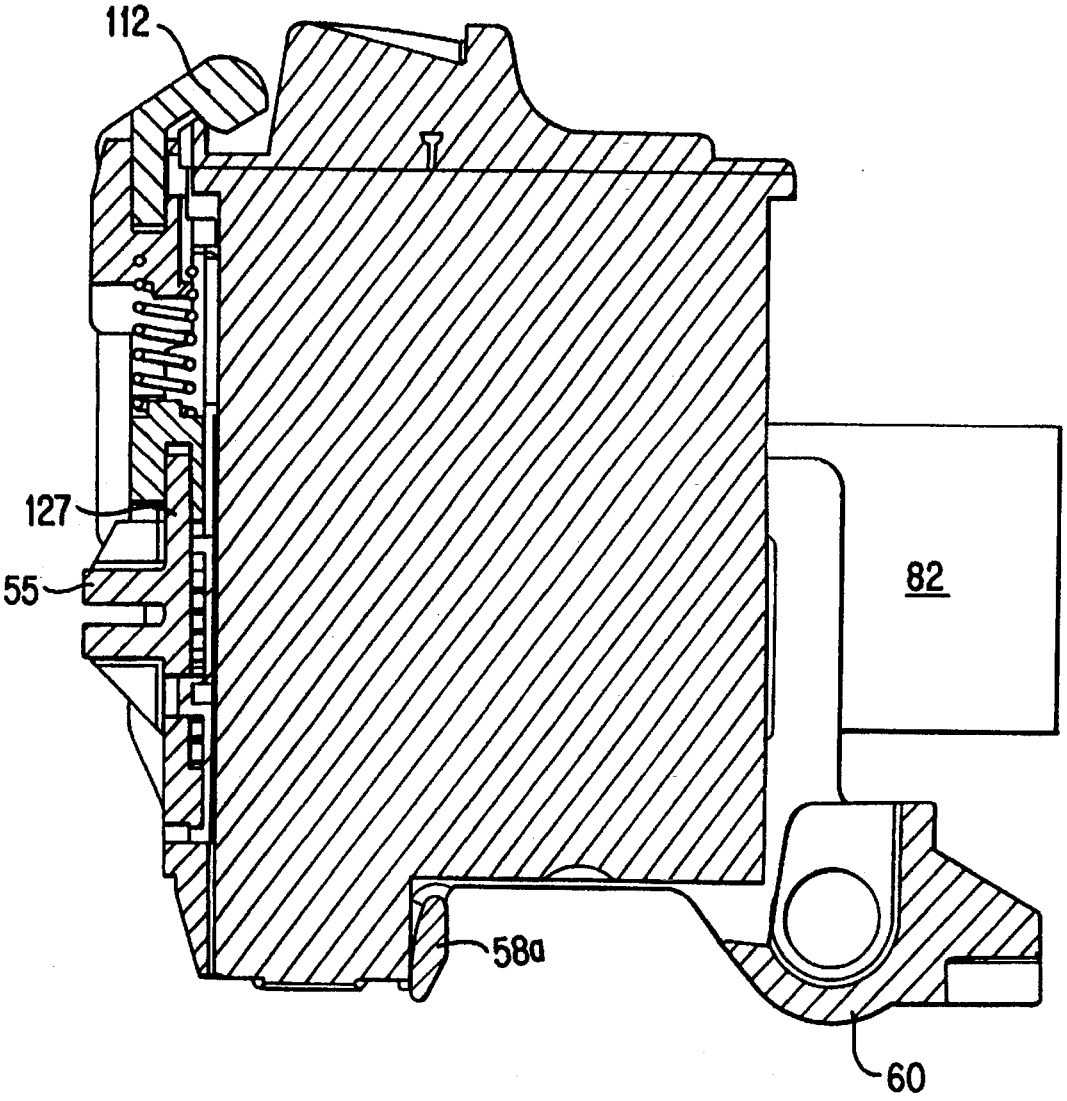
FIG. 18 is a side cut-away view of the ink cartridge mounted and latched on the ink cartridge carrier.
Figure 19:
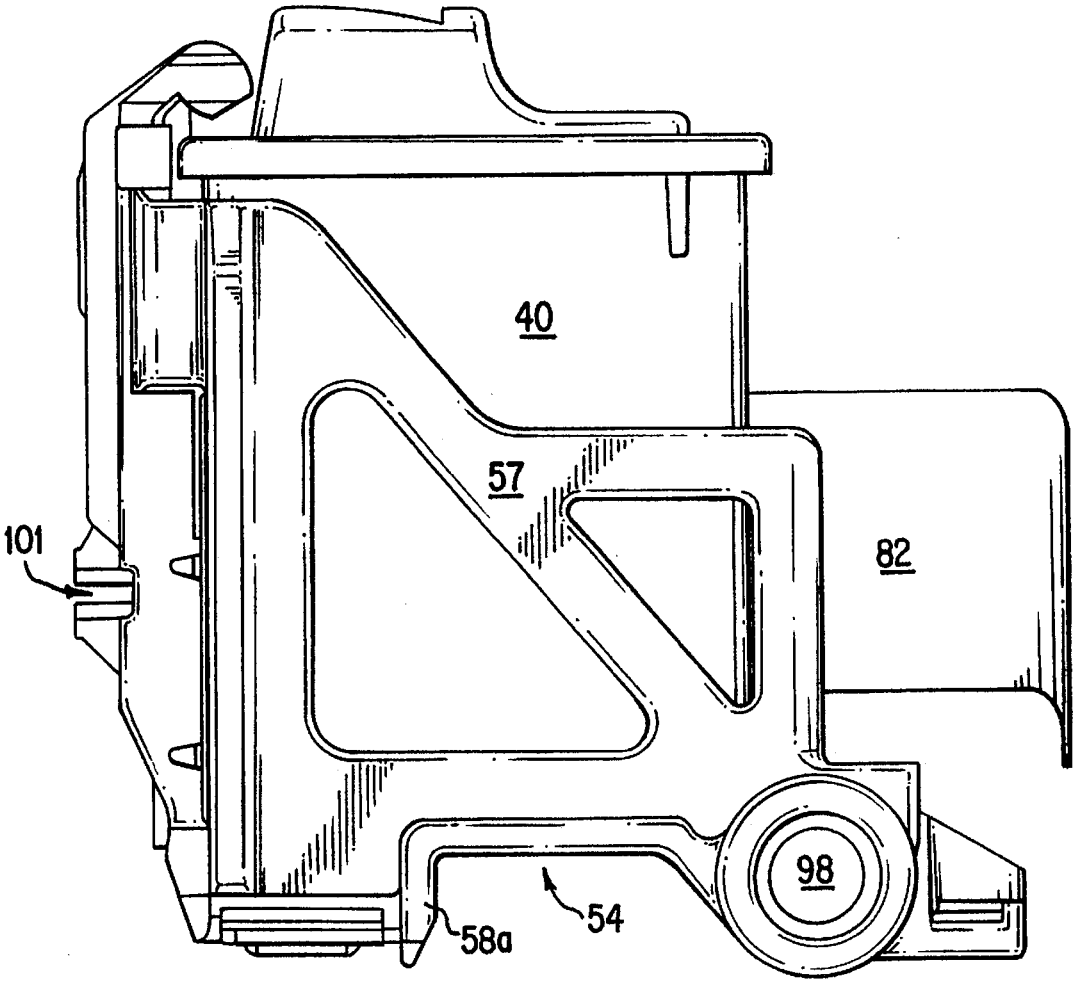
FIG. 19 is a side view of the ink cartridge carrier with an ink cartridge mounted thereon.
Figure 20:
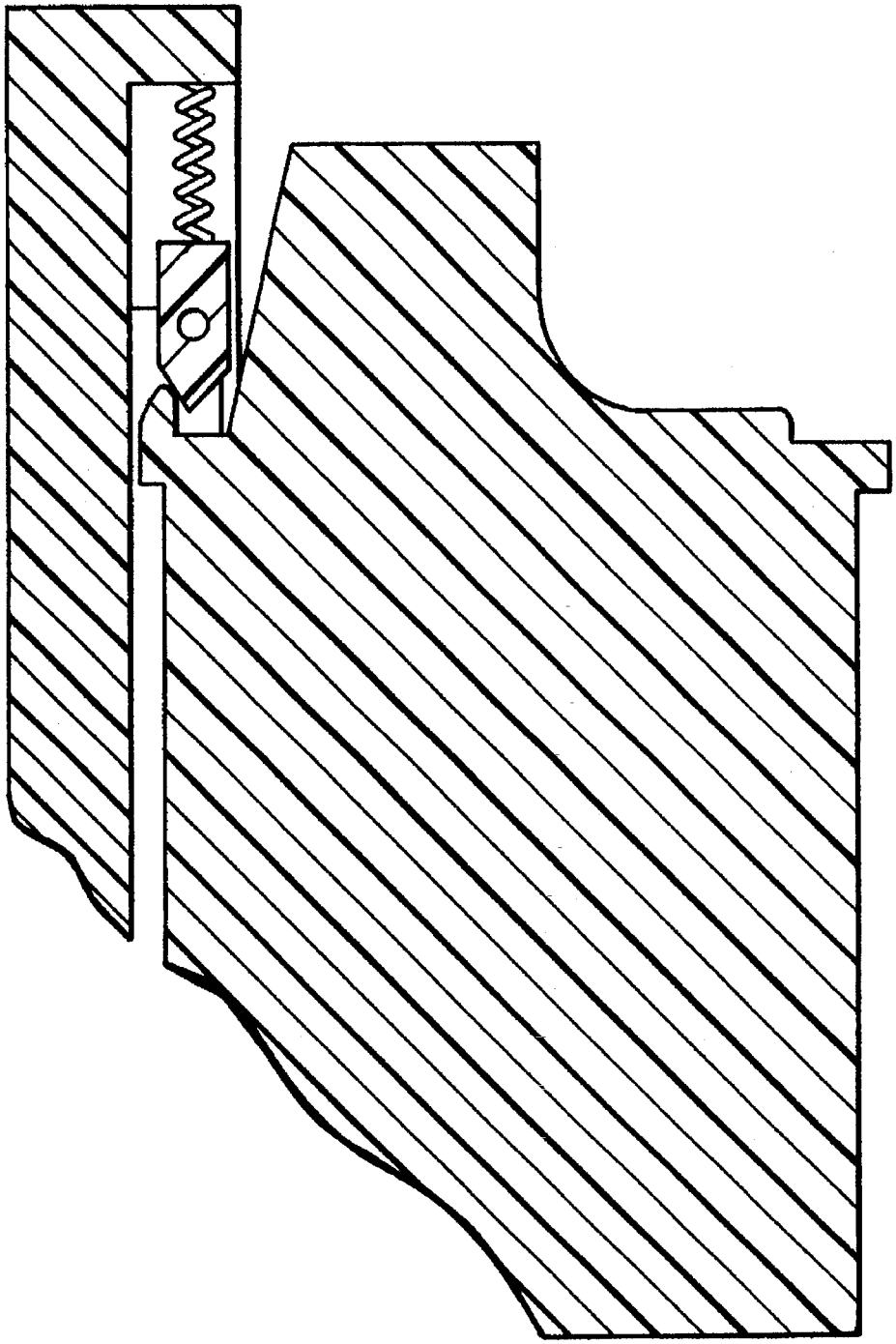
FIG. 20 PRIOR ART
FIG. 20 is a representation of a prior art latching mechanism.

The latching bracket 110 is mounted in an opening 52 formed in the center frame section 55 (FIGS. 7 and 10–12). The retention plate 116, when the latching bracket 110 is mounted to the center frame section 55, is seated on an inner side of a center brace 127 of the center frame section 55 so that the center brace 127 is seated within mounting notch 118 of latching bracket 110 (FIG. 16). The portion of the latching bracket 110 defining an edge of the spring opening 114 adjacent a lip 112 (upper edge in the figures) is received in a groove formed in the top brace 125 of the center frame section 55.

Within the opening 52,114 (resulting when the latching bracket 110 is mounted to the center frame section 55) is a spring 117 that is seated on the spring guide 115 of the latching bracket 110 and engaged with a surface of the opening 52, the surface opposing the spring guide 115. To retain and guide the spring 117, the engagement surface found in top brace 125 of center frame section 55 is formed as a spring retention notch 126.

The latching bracket also has at its upper end (in the Figures) the lip 112. The spring 117, between the spring retention notch 126 in the top brace 125 of the center frame section 55 and the spring guide 115, applies a pressure to force the latching bracket 110 downwardly (in the Figures) so as to seat mounting notch 118 on center brace 127 of center frame section 55.

The mounting of the latching bracket 110 on the center frame section 55 is stabilized by the top brace 125 of the center frame section 55. The portion of the latching bracket 110 above the spring opening 114 is retained within a notch in the upper portion of the top brace 125 thus slidably attaching the latching bracket 110 at a second point to the center frame section 55. The spring 117, as previously described, engages an upper surface of the opening 52 of the center frame section 55 by being seated within a spring retention notch 126 found in the top brace 125 to complete the mounting.

Figure 15:
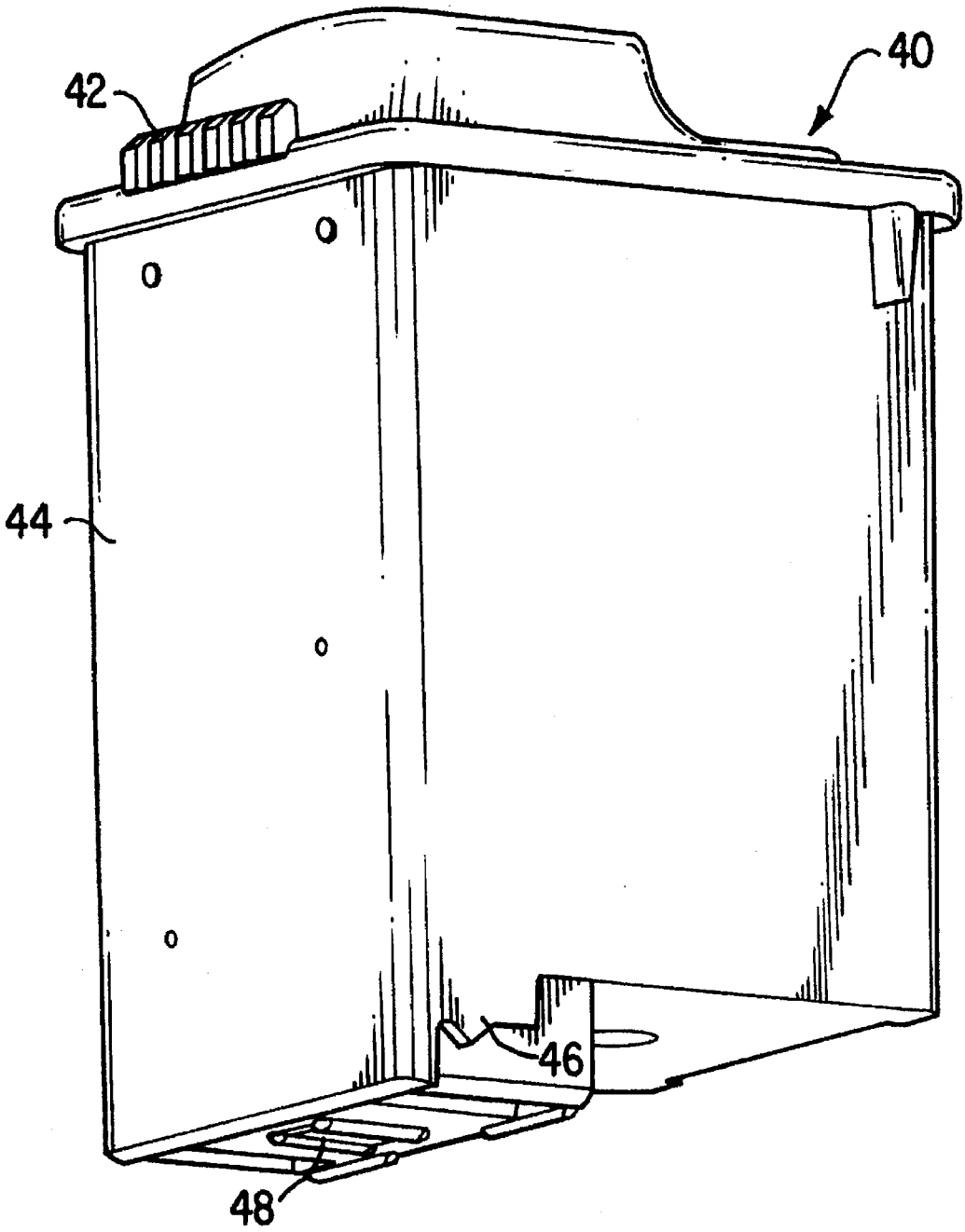
FIG. 15 is a perspective view of the ink cartridge.

Mounted to an inner surface, that is a surface of center frame section 55 facing into the area defined by first and second side frame sections 56,57, is a contact spring member 130 having contact springs 131 formed thereon. The contact spring member 130 and contact springs 131 are formed of a resilient substance, such as silicon rubber. They may have different resiliences or substantially the same resiliences. The contact springs 131 are formed on the contact spring member 130 in a pattern corresponding to the electrical contacts found on the contact surface 44 (FIG. 15) of the ink cartridge 40 and on the flexible cable 80. Another type of contact spring structure is disclosed in U.S. Pat. No. 4,706,097.

Figure 13:
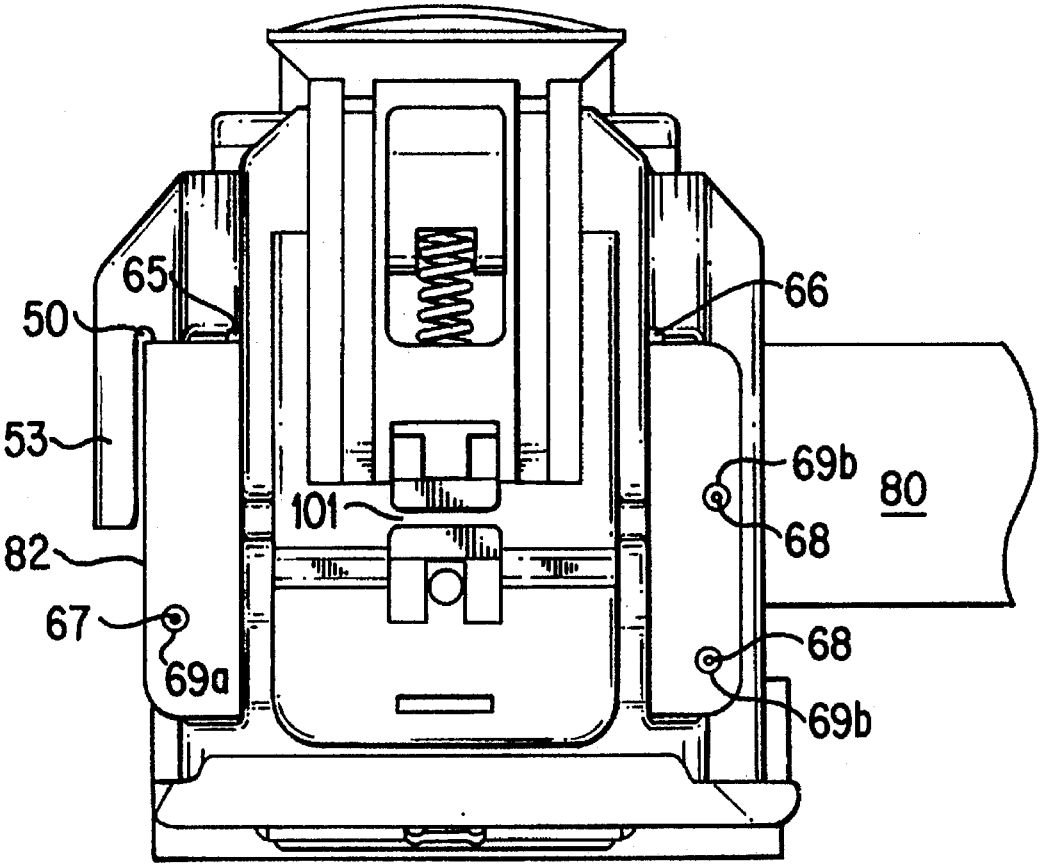
FIG. 13 is a rear view of the ink cartridge carrier with latching bracket and flexible cable mounted thereto.
Figure 14:
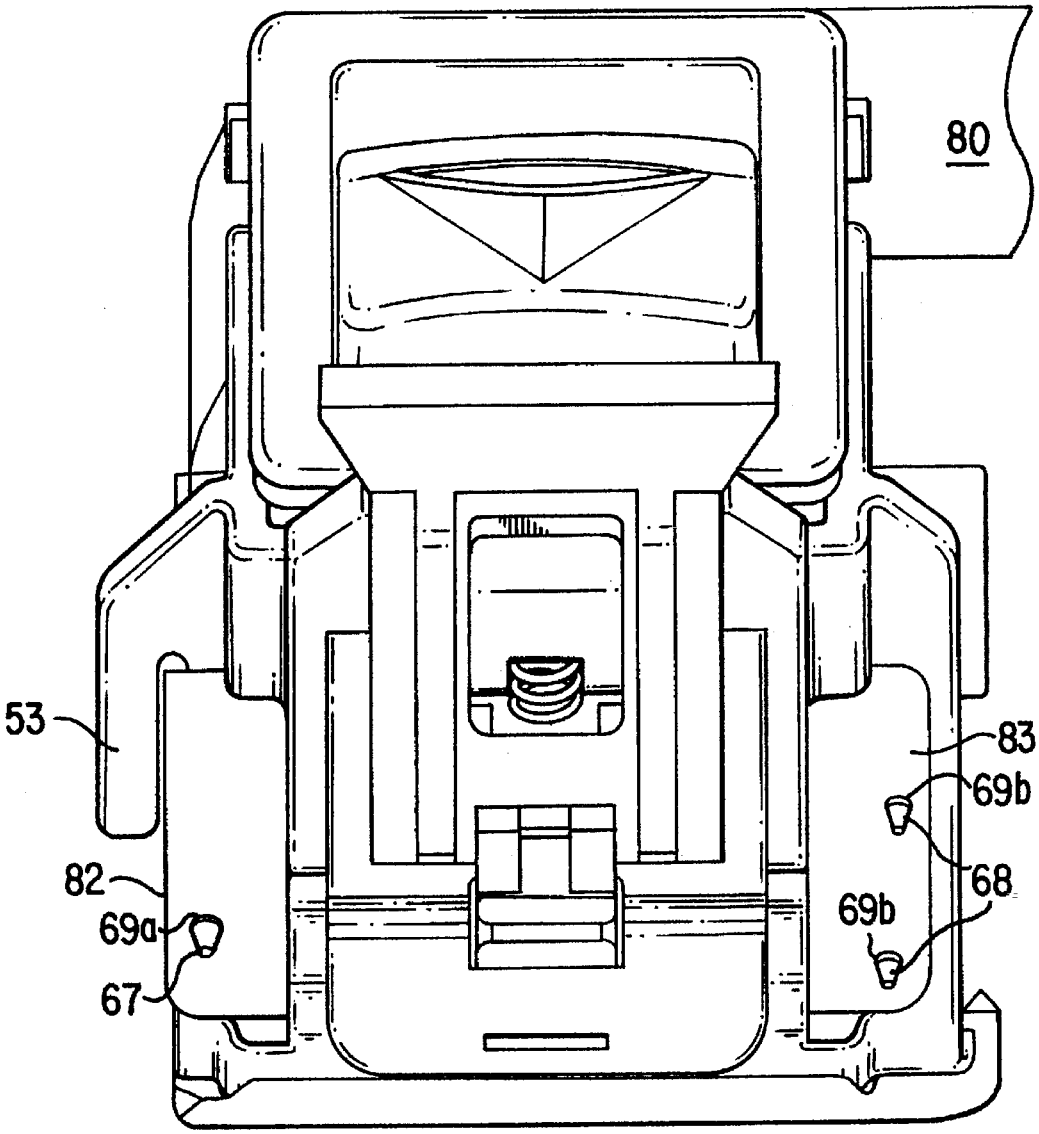
FIG. 14 is a top, rear perspective view of the ink cartridge carrier of FIG. 13.

The flexible cable 80 will be described with reference to FIGS. 2, 4, 12, 13, 14. A mounting bracket 88 is mounted to first lateral frame 72. The flexible cable 80 from the controller (not shown) has a first rigid portion 81 which provides a means for guiding the flexible cable to the cable attachment bracket 88 as well as providing means for a positive mount thereto. A second rigid section 82 guides the flexible cable 80 around the outer surface of the ink cartridge carrier 54 and through a groove 50 (FIGS. 4, 13 and 14).

Figure 11:
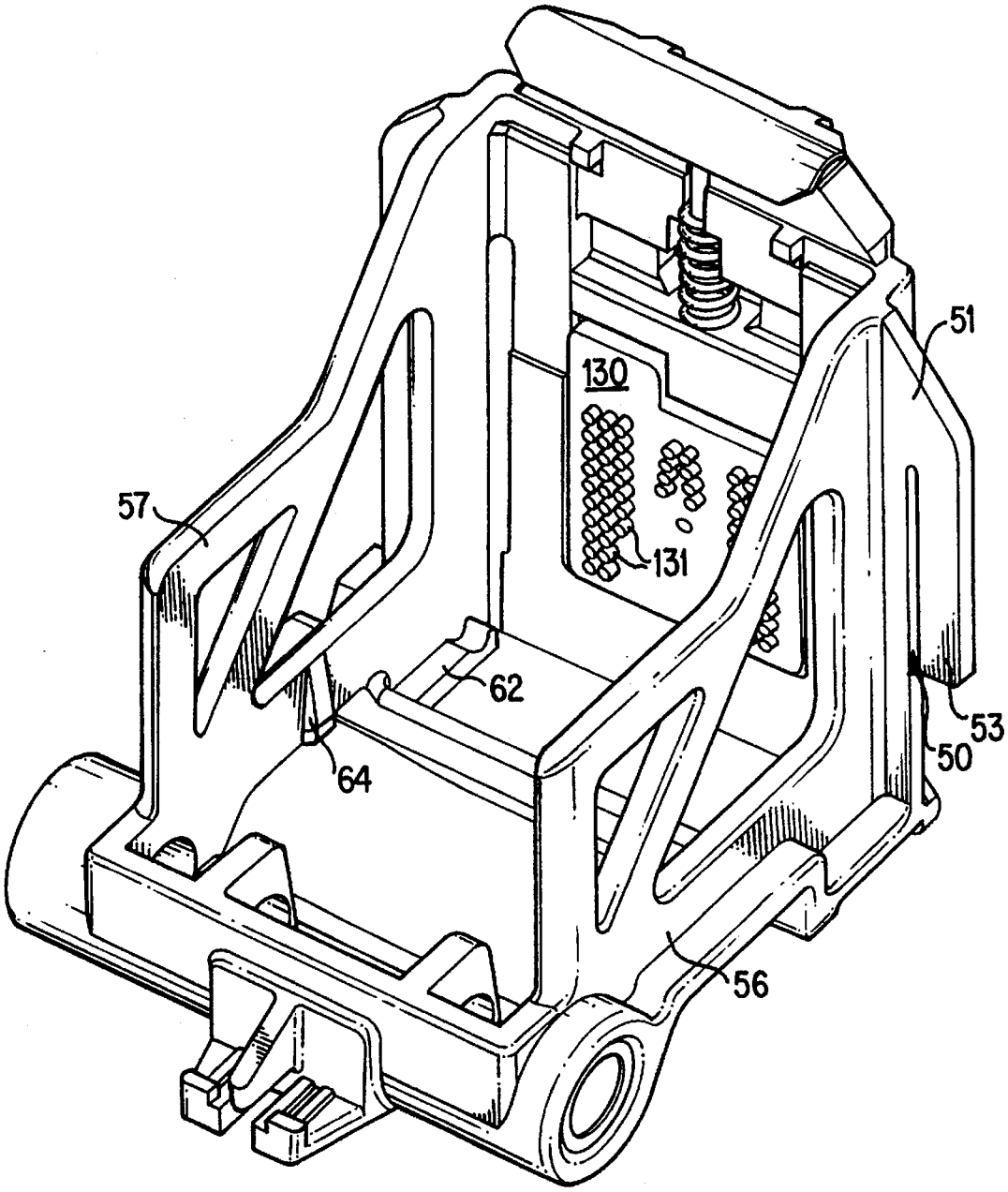
FIG. 11 is a right front, top perspective view of the ink cartridge carrier with latching bracket attached.
Figure 12:
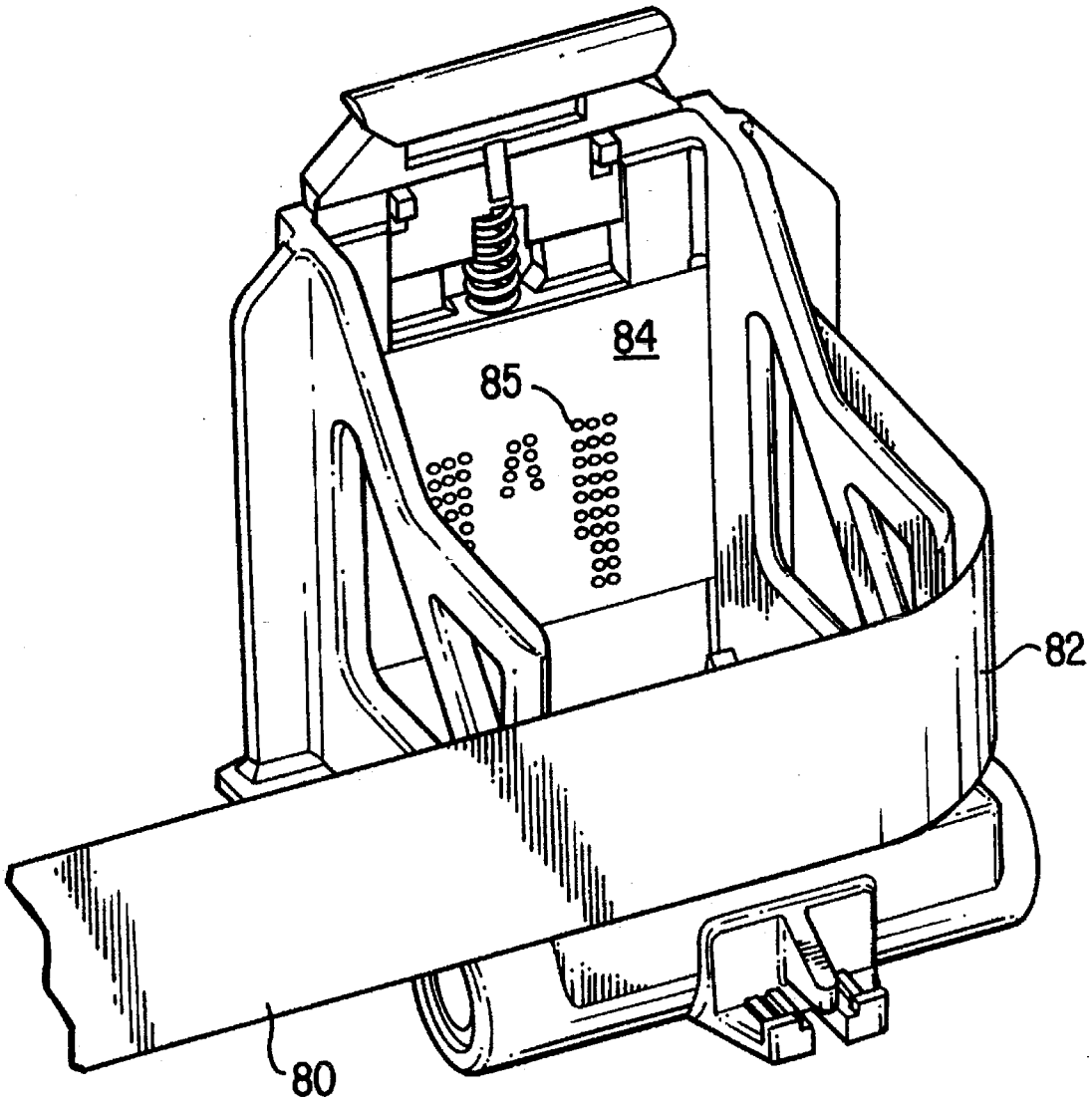
FIG. 12 is a front, top perspective view of the ink cartridge carrier with the flexible cable mounted thereto.

The groove 50 is formed in the wing 51 extending from side frame section 56 (FIG. 11). A hook 53 defines the outer side of the groove and extends approximately one-half the height of the wing 51 or the side frame section 56.

The rigid portions 81,82 are reinforced only where the path of the flexible cable 80 changes direction. Between those points, the flexible cable 80 remains flexible. The high rigidity portions, that is where the direction changes, of the flexible cable 80 may be formed by molding with an increased amount of the resin, used to form the body of the flexible cable 80, forming the high rigidity portions of the rigid portions 81,82 upon curing or by mounting reinforcing material to the flexible cable 80, such as metal or plastic strips. The section of the flexible cable 80 between the first and second rigid portions 81,82 is flexible and bows during reciprocal movement of the ink cartridge carrier 54 so as to permit movement of the ink cartridge carrier 54 from one end of the print line to the other.

One end of the flexible cable 80, adjacent rigid portion 82, permits connection of the flexible cable 80 to the ink cartridge carrier 54. Between the rigid portion 82 and an end portion 83 is a contact portion 84 containing contacts 85. The contacts 85 coincide with the contact springs 131 and the contacts on the contact surface 44 of the ink cartridge 40.

Rigid portion 82 of the flexible cable 80 has a mounting hole **69*a* and cable end 83 has mounting holes 69*b*. The mounting hole 69*a* enables rigid portion 82 to be mounted to entry the latching pin 67 and the mounting holes 69*b* on the cable end 83 are mounted to the end latching pins 68 thereby positively locating the contacts 85 of contact portion 84 between the contact springs 131 and the contacts found on the ink cartridge 40. Passage of the rigid portion 82 through groove 50 results in the hook 53 providing for a positive retention of mounting hole 69*a* on latching pin 67 to prevent an accidental disconnection of the cable 80 during reciprocable movement of the ink cartridge carrier 54**.

To mount the flexible cable 80 to latching pins 67,68, cable end 83 is passed through the slot 65, past the contact springs 131 and exited from the slot 66 so that the latching holes **69*a*, 69*b* receive the latching pins 67,68**.

Figure 6:
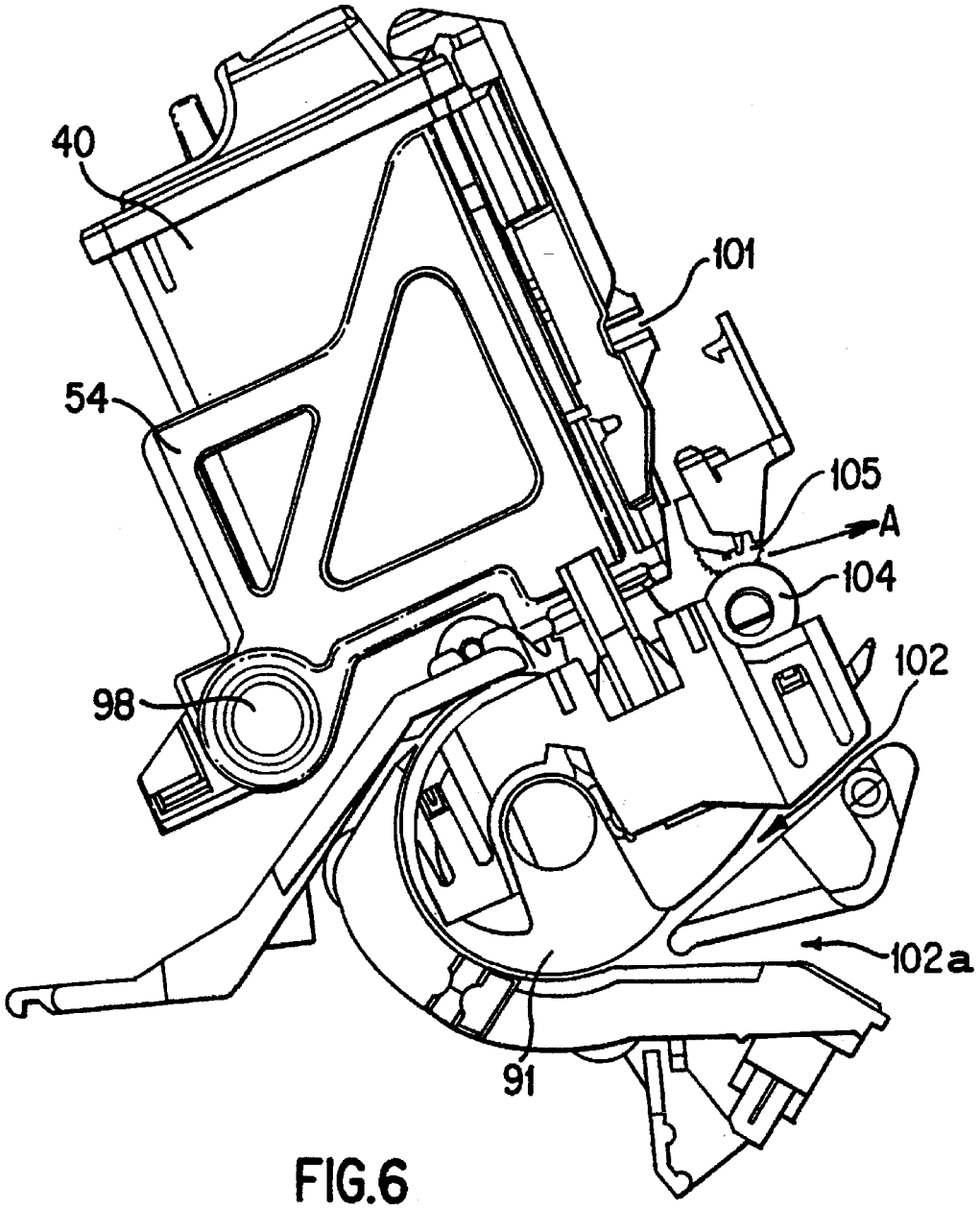
FIG. 6 is a side view of the ink cartridge carrier at the cleaning position.
Figure 7:
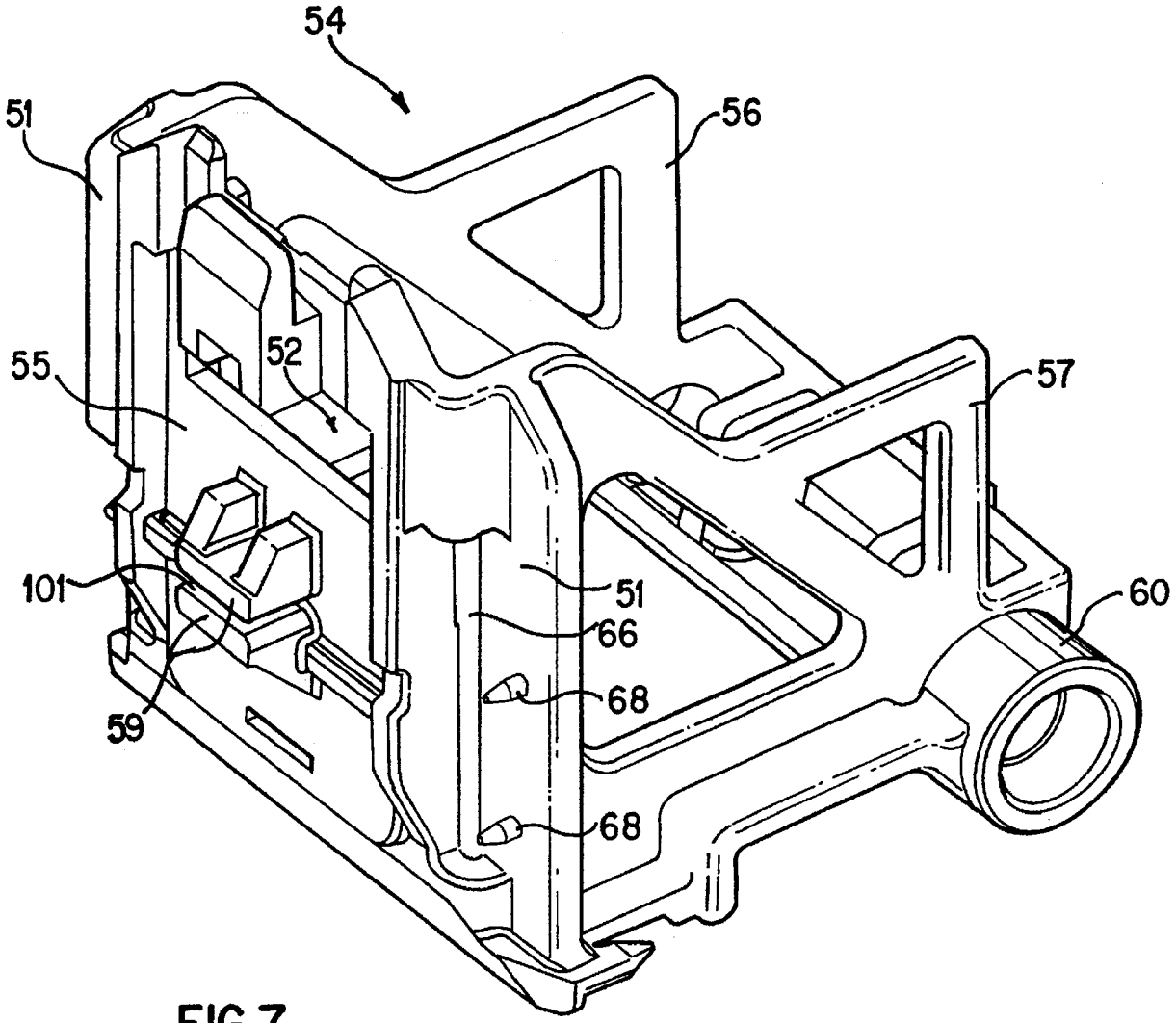
FIG. 7 is a top, rear perspective view of the ink cartridge carrier.
Figure 8:
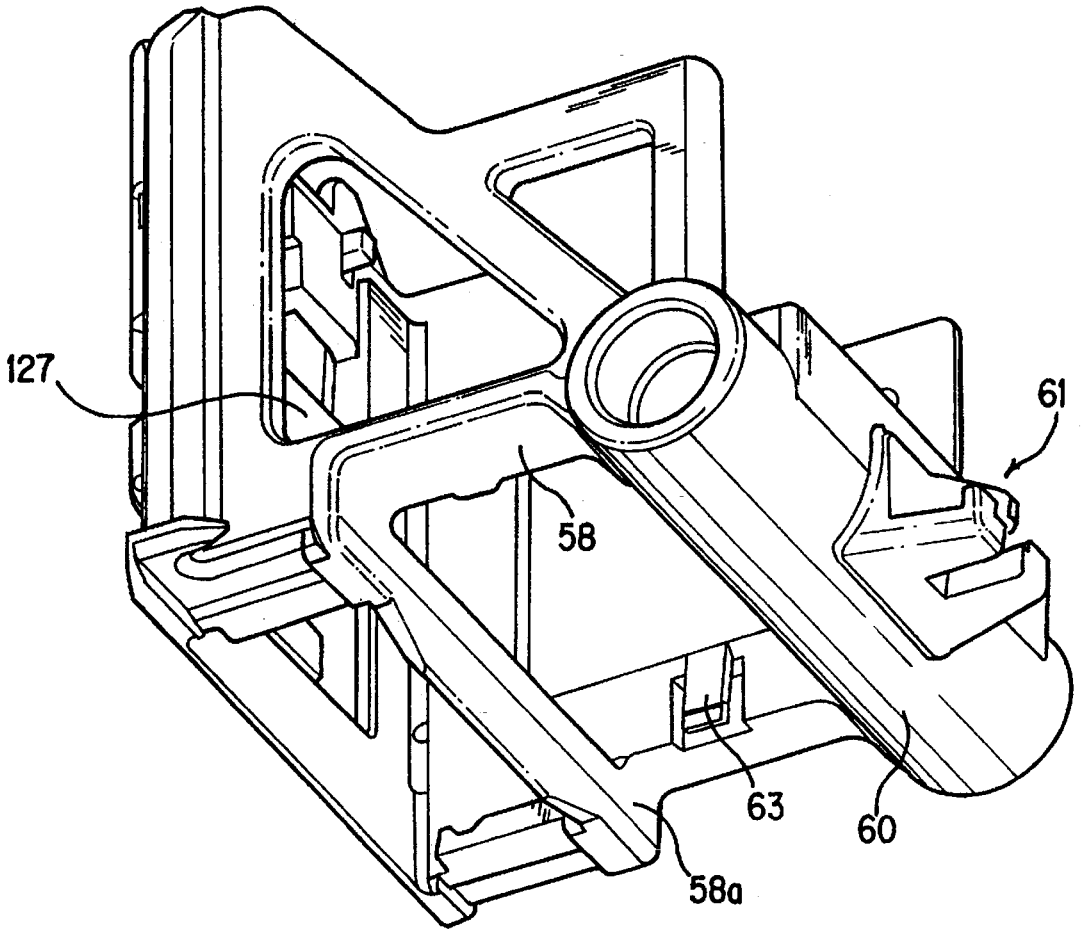
FIG. 8 is a bottom, front perspective view of the ink cartridge carrier.

The ink cartridge 40 for use with the invention will be described with reference to FIGS. 2, 6 and, most particularly, 15. The ink cartridge 40 has an engagement piece 42 on its upper surface (as shown in the Figures). At its lower surface is a nozzle plate 48. At a lower end of each side surface is a mounting foot 46. A front face directly below the engagement piece 42 comprises a contact surface 44 having a plurality of contacts (not shown in detail) corresponding to the number of nozzles thereon.

In operation, the flexible cable 80 is attached to the ink cartridge carrier 41 by inserting the cable end 83 through the slot 65 and exiting the slot 66 thereby positioning the contact portion 84 opposite the contact springs 131 so that the pattern of the contacts 85 on the contact portion 84 is matched with the contact springs 131. The latching holes **69*a*,69*b* are seated on the latching pins 67,68 to positively position the contact portion 84 of the flexible cable 80**.

The ink cartridge 40 is mounted on the ink cartridge carrier 54 as shown in FIGS. 16–19. The nozzle plate 48 section of the ink cartridge 40 is inserted between the positioning bar **58*a* of the base frame section 58 and the center frame section 55. The upper portion of the ink cartridge 40 is then pushed toward the center frame section 55. A chamfered surface of the engagement piece 42 engages a chamfered surface of the lip 112 of the latching bracket 110. The lip 112 is pushed upwardly against the tension force of the spring 117 until the chamfered surface of the lip 112 passes by the chamfered surface of the engagement piece 42 wherein the tension of the spring 117 retracts the lip 112 over the engagement piece 42 thereby positively engaging and seating the ink cartridge 40 on the ink cartridge carrier 54**.

Further, to properly align the ink cartridge 40 laterally, the second side frame section 57 is provided with a rigid ink cartridge guide 64 and the first side frame section 56 is provided with a semi-rigid ink cartridge guide 63. Alternatively, the rigid ink cartridge guide 64 could be provided on the first frame section 56 and the semi-rigid ink cartridge guide 63 could be provided on the second frame section 57. At this time, the contacts on the contact surface 44 are in positive contact with the contacts 85 found on the contact portion 84 of the flexible cable 80 and printing may be conducted.

To release an expended ink cartridge 40 from the ink cartridge carrier 41, the operator grasps the ends of the lip 112, pulling the lip 112 upwardly to disengage the lip 112 from the engagement piece 42. The lip 112, on each side, has an angled surface such that the lip is narrower at its bottom surface (closed to the opening 114) and wider at its upper surface for ease in pulling (FIG. 13). The angle formed between the top surface and the angled surface is in a range of about 40° to 60° and is preferably about 50°. During removal, the ink cartridge 40 is rotated toward the guide shaft mount 60 and lifted from its position on the ink cartridge carrier 54.

What is claimed is:

1. A carriage for an ink jet cartridge having a nozzle section, comprising:

a first side section, a second side section and a connecting section, said first side section, second side section and connecting section having a U-shape configuration;

a positioning bar attached to and extending between said first side section and said second side section parallel to and offset from said connecting section;

a latching spring; and a latching member mounted to said connecting section wherein said connecting section has an opening for receiving a first part of said latching member and said latching spring is mounted between and in contact with said first part of said latching member and an opposing part of said opening of said connecting section.

2. The carriage according to claim 1, wherein said latching member has a lip at an end away from said first part for engaging the ink jet cartridge.

3. The carriage according to claim 2, wherein said lip has angled end surfaces with each end surface at an angle to a top and bottom surface of said lip.

4. The carriage according to claim 1, wherein said first side section and second side section each have a cartridge support between said connecting section and said positioning bar.

5. The carriage according to claim 4, wherein said positioning bar is separated from said connecting section by a distance substantially equal to a width of the nozzle section of the ink jet cartridge.

6. The carriage according to claim 5, wherein when the ink jet cartridge is mounted to said carriage, the nozzle section is received between said connecting section and said positioning bar and seated in contact with said cartridge supports.

7. The carriage according to claim 6, wherein said latching member has a lip at an end away from said first part for engaging the ink jet cartridge, said latching member locking the ink jet cartridge in position against said cartridge supports.

8. The carriage according to claim 7, wherein said lip has angled end surfaces with each end surface at an angle to a top and bottom surface of said lip.

9. The carriage according to claim 8, further comprising:

a one of a rigid ink cartridge guide and a semi-rigid ink cartridge guide on said first side section; and an other of the rigid ink cartridge guide and the semi-rigid ink cartridge guide on said second side section, the rigid ink cartridge guide and the semi-rigid ink cartridge guide laterally aligning the ink jet cartridge.

10. A cartridge carrier used with an ink jet printer, the cartridge carrier mounted in said printer for reciprocal movement, comprising:

a first side frame section;

a second side frame section;

a center frame section attached at right angles to said first frame section and said second frame section so said first frame section, center frame section, and second frame section have a U-shape configuration;

a base frame section, mounted to said first frame section, second frame section and center frame section, comprising a guide shaft mount and a positioning bar; and a latching element for latching an ink cartridge to the cartridge carrier, wherein said latching element has a spring mounted internally for urging said latching element to a latching position, wherein said center frame section has an opening with a center brace defining a side of the opening and a top brace defining an opposite side of the opening, said latching element slidably mounted to said center brace and said top brace.

11. The cartridge carrier according to claim 10, wherein said latching element has a center opening, one side of said center opening defined by a retention plate.

12. The cartridge carrier according to claim 11, wherein said spring is seated in a combined opening between said retention plate of said latching element and said top brace of said center frame section.

13. The carriage according to claim 12, wherein said latching element has a lip having angled end surfaces with each end surface at an angle to a top and bottom surface of said lip.

14. The carriage according to claim 8, further comprising:

a one of a rigid ink cartridge guide and a semi-rigid ink cartridge guide on said first side frame section; and an other of the rigid ink cartridge guide and the semi-rigid ink cartridge guide on said second side frame section, the rigid ink cartridge guide the semi-rigid ink cartridge guide laterally aligning the ink cartridge.

15. The cartridge carrier according to claim 10, wherein said latching means has an L-shaped retention plate attached to a surface of said latching means facing said center frame section, a mounting notch formed between said surface and a longitudinal leg of said retention plate for receiving said center brace of said center frame section therein.

16. An ink cartridge carrier for mounting an ink cartridge for use in an ink jet printer, comprising:

frame means for providing a receiving section for mounting the ink cartridge;

latching means slidably mounted to said frame means for securing said ink cartridge; and a spring mounted between said frame means and said latching means, wherein said frame means and said latching means have an opening therein, a first end of said opening formed by said frame means and an opposing second end formed by said latching means, said spring mounted in said opening.

17. The ink cartridge carrier according to claim 16, wherein said latching means has a spring guide engaging said spring and said frame means has a notch in which the other end of said spring is seated.

18. The ink cartridge carrier according to claim 16, wherein said latching means has a lip, said lip has angled end surfaces with each end surface at an angle to a top and bottom surface of said lip.

19. The ink cartridge carrier according to claim 18, wherein said frame means comprises a first side frame section and a second side frame section, wherein:

a one of a rigid ink cartridge guide and a semi-rigid ink cartridge guide on said first side frame section; and an other of the rigid ink cartridge guide and the semi-rigid ink cartridge guide on said second side frame section, the rigid ink cartridge guide and the semi-rigid ink cartridge guide laterally aligning the ink jet cartridge.

* * * * *